US005871171A

United States Patent [19]

Kenney et al.

[11] Patent Number: 5,871,171

[45] Date of Patent: Feb. 16, 1999

[54] MOLDED PRODUCT OF RECYCLED PLASTIC AND RUBBER

[75] Inventors: Terry Kenney, 13550—15 Avenue, Blairmore, AB, Canada, T0K 0E0; Paul Crawford, Calgary, Canada

[73] Assignee: Terry Kenney, Calgary, Canada

[21] Appl. No.: 654,588

[22] Filed: May 29, 1996

Related U.S. Application Data

[63] Continuation-in-part of Ser. No. 311,407, Sep. 23, 1994, abandoned.

[51] Int. Cl.[6] ..... B65H 75/14

[52] U.S. Cl. ..... 242/610.4; 242/610.6

[58] Field of Search ..... 242/608.4, 609.1, 242/610.4, 610.6, 118.32, 118.7, 118.8

[56] References Cited

U.S. PATENT DOCUMENTS

| | | | |
|---|---|---|---|
| 503,227 | 8/1893 | Benham | 242/609.1 |
| 3,643,888 | 2/1972 | Blue | 242/118.32 |
| 3,819,124 | 6/1974 | Marks et al. | 242/610.4 |
| 4,021,001 | 5/1977 | Sproat | 242/610.4 |
| 4,066,224 | 1/1978 | Hargreaves et al. | 242/608.4 |
| 4,253,570 | 3/1981 | O'Connor et al. | 242/118.7 |
| 4,412,661 | 11/1983 | Wise et al. | 242/610.4 |
| 4,895,316 | 1/1990 | Salloum | 242/608.4 |
| 4,989,802 | 2/1991 | Akao et al. | 242/610.6 |
| 5,139,209 | 8/1992 | Kramer | 242/610.4 |
| 5,177,139 | 1/1993 | Klaar et al. | 524/484 |
| 5,180,629 | 1/1993 | Terada et al. | 428/220 |
| 5,219,913 | 6/1993 | Tomomatsu et al. | 524/451 |
| 5,221,702 | 6/1993 | Richards | 524/59 |
| 5,246,184 | 9/1993 | Trewhella | 242/608.4 |
| 5,340,050 | 8/1994 | Renck | 242/609.1 |
| 5,405,101 | 4/1995 | Toral et al. | 242/610.6 |

*Primary Examiner*—John M. Jillions
*Attorney, Agent, or Firm*—Robert H. Barrigar; Barrigar & Moss

[57] ABSTRACT

A cable reel or cable reel assembly for use in transporting and storing cable of length, diameter and weight up to a predetermined reel capacity. The cable reel, or cable reel assembly when assembled, includes a generally cylindrical cable-receiving drum, which in the case of the cable reel assembly is assembled from a plurality of drum components, and a pair of opposed flanges that are fixed to the ends of the drum and retain wound cable in place on the drum. The drum is made of a material, and has dimensions, that enable it to resist bending under the load of the cable wound on the drum and to resist cable loading and unloading stresses. The opposed flanges resist the lateral load applied to the cable reel by the wound cable. The flanges are made from a selected blended rubber-plastics composition and have dimensions selected to resist bending due to the lateral load of the cable wound on the drum, and due to the stress applied to the flanges by the drum bearing the cable.

50 Claims, 5 Drawing Sheets

MOLDED PRODUCT OF RECYCLED PLASTIC AND RUBBER

RELATED APPLICATION

This application relates to a molded cable reel or spool and is a continuation-in-part of U.S. patent application Ser. No. 08/311,407 filed on 23 Sep., 1994, now abandoned.

BACKGROUND OF THE INVENTION

Cable reels or spools are conventionally made from construction lumber, steel, plywood and cardboard. The distinction between a reel and a spool is essentially a distinction of size. In this specification, any reference to a "reel" (which will be the term usually chosen) should be understood as embracing a spool as well as a reel.

Conventional cable reels comprise a centrally located drum of generally cylindrical configuration at both ends of which are provided circular flanges of substantially wider diameter than the diameter of the drum so that cable may be coiled around the drum and retained in place by the flanges. The flanges are constructed according to conventional practice by nailing together layers of boards, each successive layer being aligned generally perpendicular to the adjacent layer so as to strengthen the flange. Successive layers are added until the flange reaches design thickness. Because cables, including electric power and communications cables and especially wire rope, can be very heavy, the drum must be able to bear the total cable load without undue bending, and the flanges must be able to resist buckling or undue bending by reason of the cable load.

Conventionally, the drum for such cable reels is made of a series of profiled staves manufactured from board lumber, cardboard and steel. The staves are configured into a generally cylindrical shape forming the drum. The ends of the staves fit into grooves in the flanges, these grooves having been previously milled into the inside faces of the flanges. The three elements (two flanges and central drum) of the reel are held together by means of bolts that pass through both flanges and pass through the interior of the drum.

The conventional method of manufacturing a cable reel, as described above, requires considerable labor. Further, the expense of manufacturing such reels is heavily dependent upon the widely fluctuating price of lumber. Wood being a raw material in limited supply, it is undesirable to use wood as a construction material unless other materials are unsuitable. Furthermore, the conventional manufacturing process for manufacturing cable reels generates a substantial amount of wood waste.

It is known to manufacture spools and reels of other materials, notably metal, plywood and (for lighter loads) cardboard. It is also known that various plastic materials may be molded into various shapes. However, both metal and plastics materials are expensive.

It has also been previously proposed to use mixtures of rubber and plastic to make molded articles. For example, U.S. Pat. No. 5, 219, 913 (Tomomatsu) granted 15 Jun., 1993 describes an automobile bumper made of a molded plastic/talc/rubber composition. U.S. Pat. No. 5,177,139 (Klaar) granted 5 Jan., 1993, discloses a roof sealing strip made of an elastomeric/plastic composition. U.S. Pat. No. 5, 180,629 (Terada) granted 19 Jan., 1993 describes an automobile bumper made of a specified plastic and rubber composition. U.S. Pat. No. 5,221,702 (Richards) granted 22 Jun., 1993 discloses a paving block made from a plastic/elastomeric composition. However, it is not known to provide rubber-plastics blended material for use in cable reel drums or flanges, nor is it anywhere described that such blended material would be suitable for use in cable reels, especially having regard to the loading requirements for such reels. The flanges of cable reels are required to absorb substantial tensile and sheer stresses. It is noteworthy that the articles mentioned in the aforementioned U.S. patents do not have to meet this requirement. There is no suggestion in any of the foregoing patents that a cable reel or similar article would be suitably manufactured of a composite rubber-plastics composition.

SUMMARY OF THE INVENTION

According to the invention, there is provided a cable reel for use in the transportation and storage of cable of length, diameter and weight up to a predetermined reel capacity. The cable reel includes a generally cylindrical cable receiving drum and a pair of opposed flanges fixed to the ends of the drum. The material from which the drum is made, as well as the dimensions of the drum, are selected to enable the drum to resist bending under the load of the cable wound around the drum and to resist the stresses arising from loading and unloading the cable. The opposed flanges retain the wound cable in place on the drum and resist lateral load applied to the cable reel by the wound cable. The flanges are made of a suitable blended rubber-plastics composition and are of dimensions selected to resist bending due to the lateral load of the cable wound on the drum as well as to resist bending due to stress applied to the flanges by the drum bearing the cable.

According to the invention, there is further provided a cable reel assembly that includes drum components that may be assembled into a generally cylindrical cable receiving drum. The cable reel assembly also includes a pair of opposed flanges that can be attached to the ends of the drum. Following assembly, the flanges are able to retain the wound cable in place on the drum. The flanges are formed of a suitable blended rubber-plastics composition.

Preferably, the rubber in the blended composition is obtained from used vehicular tires.

The plastics material selected for the manufacture of the cable reel or cable reel assembly may preferably be selected from recycled or reclaimed materials such as recycled polyethylene containers. Preferably, the recycled plastics material is a relatively high-density polyethylene material which provides increased strength and durability to the cable reel assembly.

Preferably, the rubber and plastic materials are supplemented by an ultraviolet stabilizing materials such as carbon. Such ultraviolet stabilizing materials are sometimes added to plastics material to prevent deterioration of the material when exposed to sunlight.

Cable reels and similar articles thus manufactured tend to be strong, durable, resistant to cracking and chipping, and well capable of carrying the lateral loads required of cable reels.

BRIEF DEFECTION OF THE DRAWINGS

In drawings which illustrate embodiments of the invention,

DETAILED DESCRIPTION OF THE INVENTION

Figure 1:
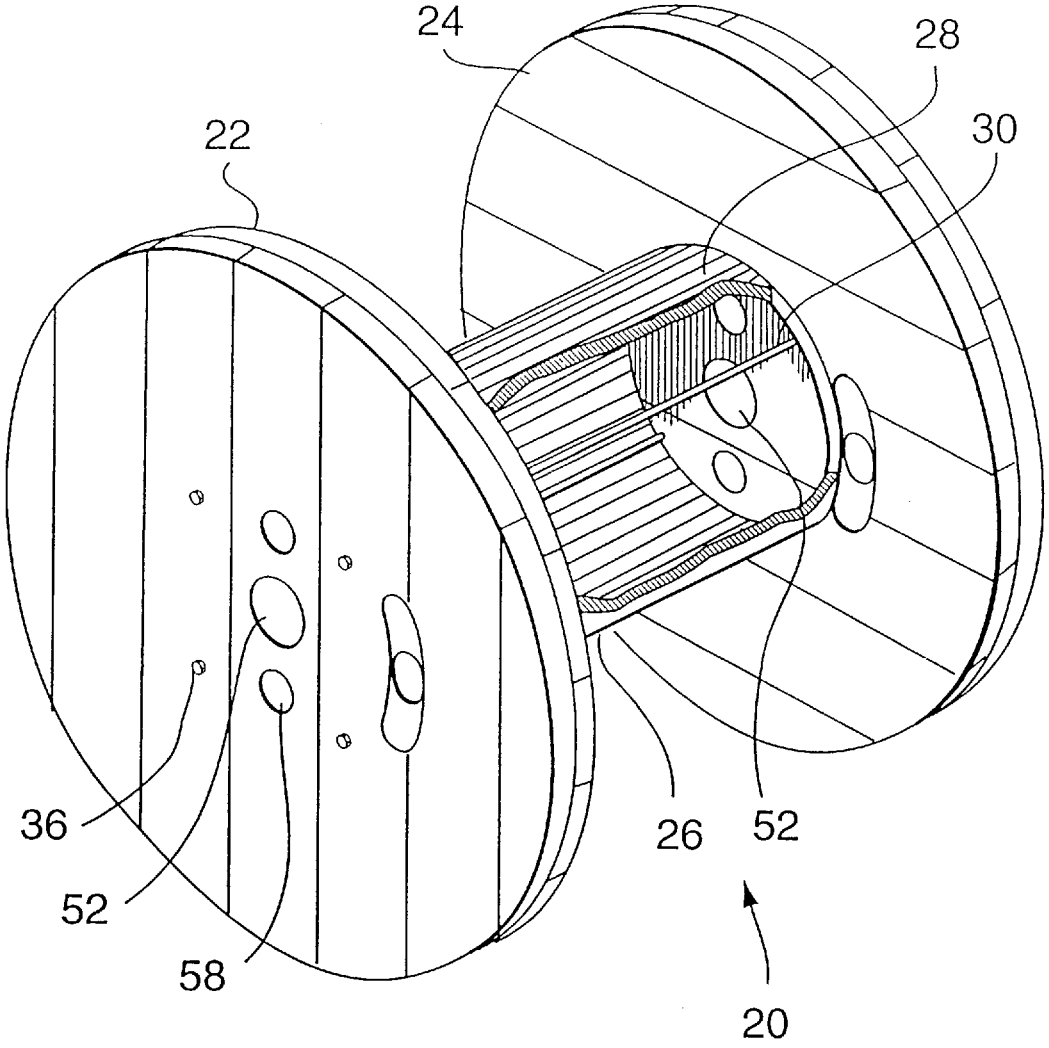
FIG. 1 is a perspective view of a cable reel, which has been partially cut away to show bolts inside the drum.

FIG. 1 shows a cable reel 20 in accordance with an embodiment of the present invention. Cable reel 20 has a drum 26 and a pair of opposed flanges 22, 24 fixed to the ends of drum 26. Drum 26 is selected to be a material and of dimensions to resist bending of drum 26 under the load of the cable wound on drum 26 and to resist cable loading and unloading stresses. The pair of opposed flanges 22, 24 retain wound cable in place on drum 26 and resist the lateral load applied to cable reel 20 by the wound cable. Flanges 22, 24 are made of a blended rubber-plastics composition and are of dimensions selected to enable flanges 22, 24 to resist bending due to the lateral load of the cable wound on drum 26 and to the stress applied to flanges 22, 24 by drum 26 bearing the cable. In a preferred embodiment, the rubber used for the pair of opposed flanges 22, 24 comes from used vehicular tires. Preferably, flanges 22, 24 are substantially identical. In a further embodiment, the plastics material used to making flanges 22, 24 includes high density polyethylene.

In the embodiment shown in FIG. 1, drum 26 includes a number of transversely extending staves 28. Each stave 28 has one end constrained to part of flange 22 and the other end constrained to part of flange 24. Preferably, each of staves 28 is detachable from flanges 22, 24. Each of flanges 22, 24 include a central channel 52 for receiving an arbor positioned within the cylindrical space enclosed by staves 28. Drive holes 58 are provided in each of the flanges 22, 24 to enable the cable reel 20 to be drivingly rotated.

Figure 2:
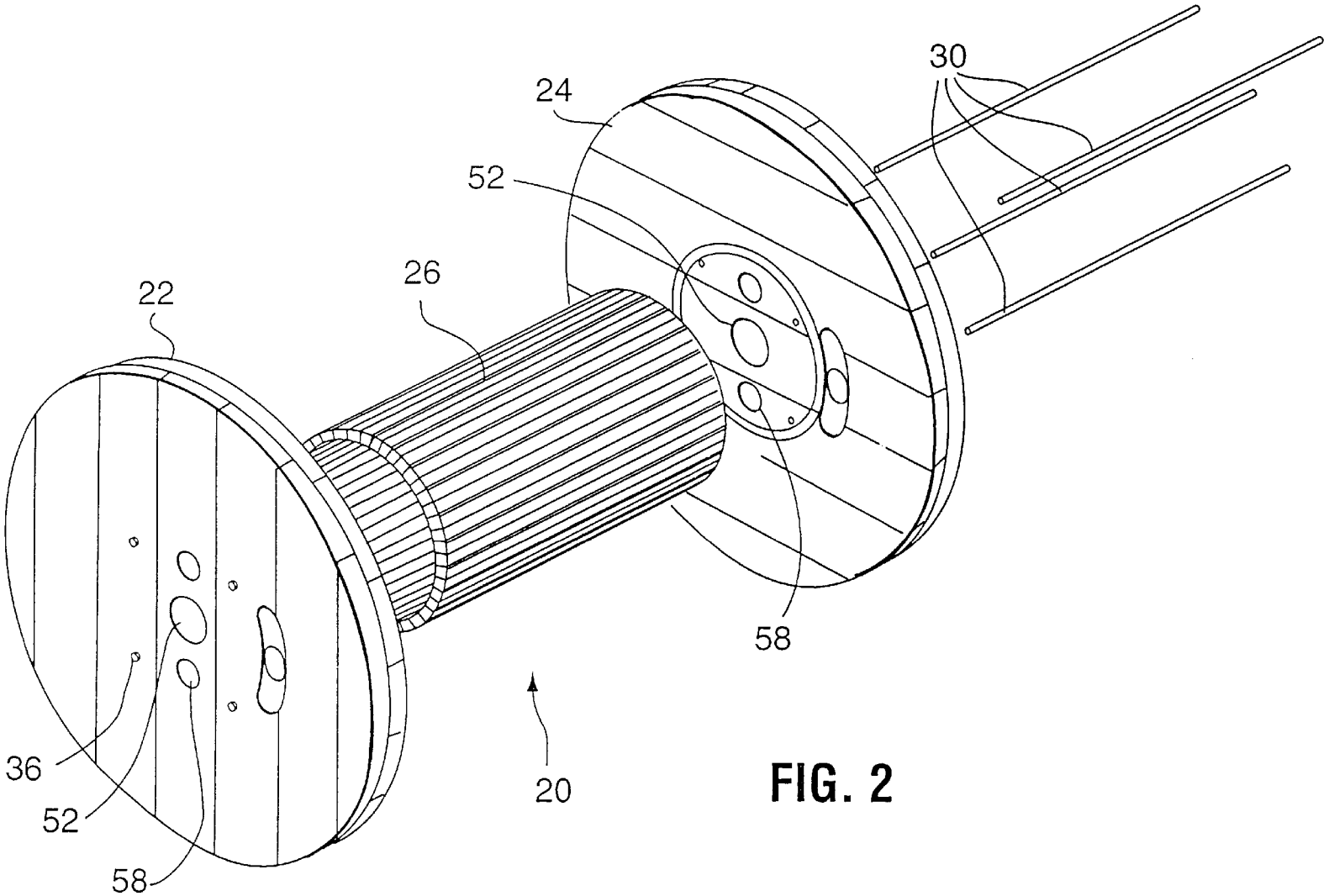
FIG. 2 is an exploded view of the cable reel of FIG. 1.
Figure 11:
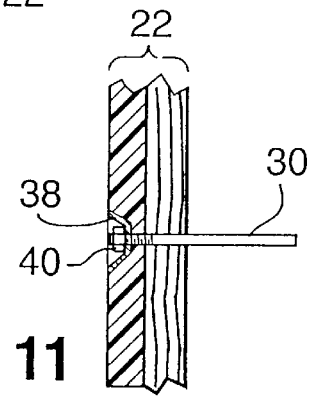
FIG. 11 is a cross-sectional view of the nut and bolt attachment to the flange.

In FIG. 2, cable reel 20 of FIG. 1 is illustrated in an exploded view. Cable reel 20 is shown with one flange 24 separated from drum 26. Bolts 30 are shown as they would appear when withdrawn from cable reel 20. As shown in FIG. 11, bolts 30 may be fastened to flanges 22, 24 by means of washers 38 and nuts 40, which also enable bolts 30 to be detached from flanges 22, 24. When attaching flanges 22,24, bolts 30 are positioned within the cylindrical space enclosed by drum 26.

Figure 3:
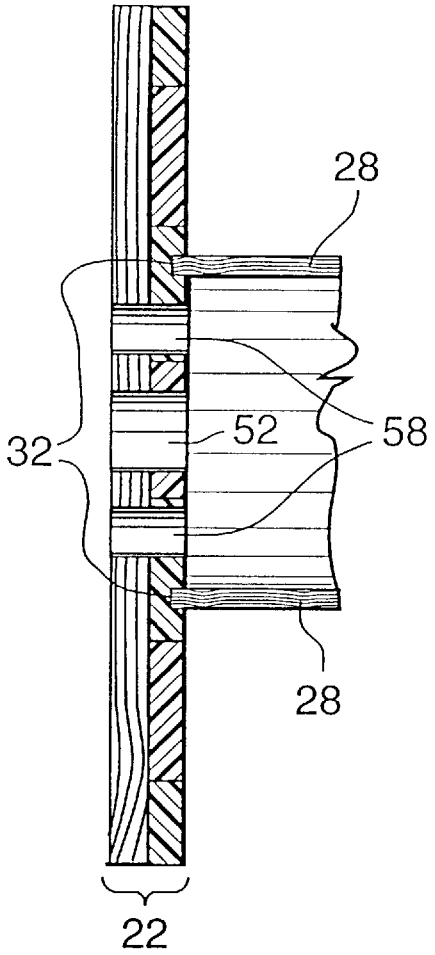
FIG. 3 is a cross-sectional view of one of the flanges.

In the embodiment shown in FIG. 3, each of flanges 22, 24 has an associated groove 32, 34. Each end of cylindrical drum 26 is retained by one flange 22 by extending into an associated generally circular groove 32, and is retained in other flange 24 by extending into an associated generally circular groove 34. Each end of cylindrical drum 26 is held in grooves 32, 34 by bolts 30 detachably fastened, by means of washers 38 and nuts 40, to each flange 22, 24.

Figure 4:
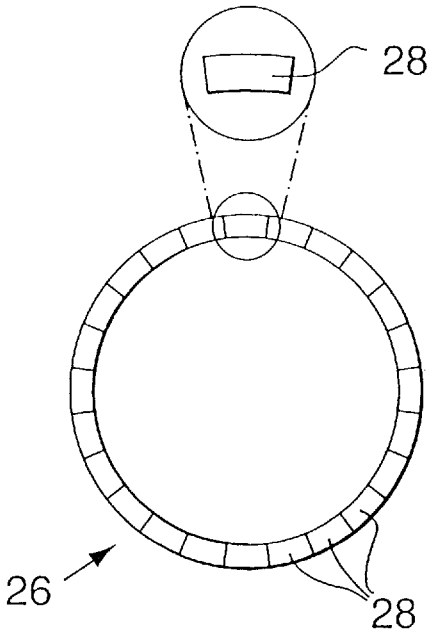
FIG. 4 is a cross-sectional view of the drum and the staves making up the drum.

Referring to the embodiment shown in FIG. 4, drum 26 is made from a number of staves 28. Each of staves 28 has one end retained in a flange 22 by an associated groove 32, and the other end retained in a flange 24 by projecting into associated groove 34. Staves 28 may be made from wood, or may be made from rubber blended with plastics material. When staves 28 are made from a rubber blended with a plastics material, the plastics material preferably includes high-density polyethylene.

Figure 5:
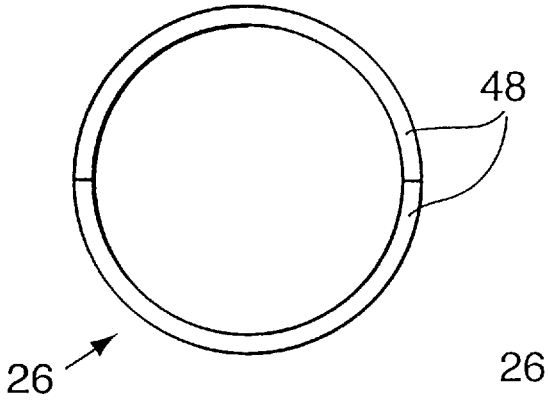
FIG. 5 is a cross-sectional view of the drum where the drum is formed by curved portions that fit together to make a cylindrical drum.
Figure 6:
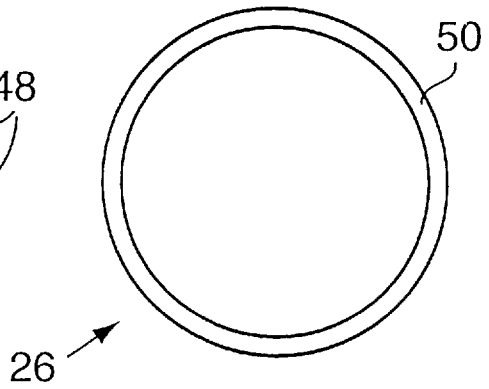
FIG. 6 is a cross-sectional view of a cylindrical drum.

Referring to the embodiment shown in FIG. 6, according to another embodiment of the invention, drum 26 comprises a cylinder 50 made from a rubber blended with a plastics material. Preferably, the plastics material is made of high-density polyethylene. In a further embodiment shown in FIG. 5, cylinder 50 includes a number of curved portions 48 which fit together to form cylinder 50. Each end of cylinder 50 is preferably held in grooves 32.,34 by bolts 30 detachably fastened to each flange 22, 24 by means of washers 38 and nuts 40. Bolts 30 are positioned within the cylindrical space enclosed by cylinder 50.

Figure 7:
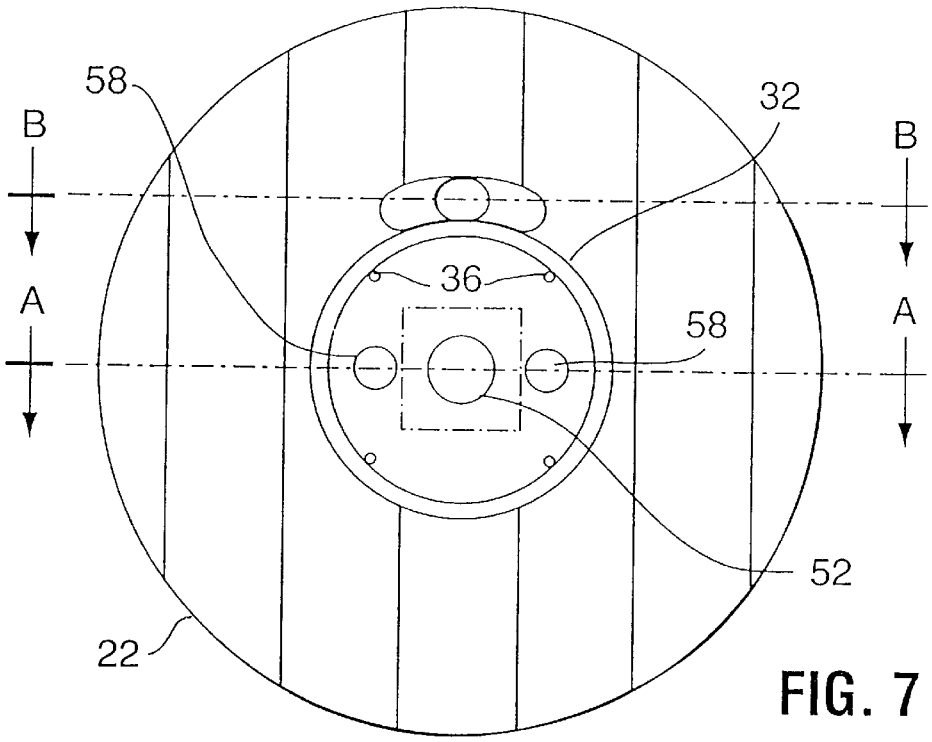
FIG. 7 is a top view of the interior side of the flange.

In the embodiment shown in FIG. 7, flanges 22, 24 include central channel 52 for receiving an arbor positioned within the cylindrical space enclosed by drum 26.

Figure 8:
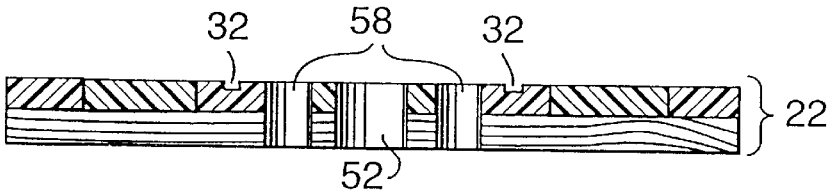
FIG. 8 is a cross-sectional view through the line A—A of FIG. 7.

Referring to the embodiment shown in FIG. 8, each of flanges 22, 24 has drive holes 58 for turning cable reel 20. Drum 26 of cable reel 20 is made of cardboard in one embodiment, and is made from metal in another embodiment. Where drum 26 is made from cardboard, it is preferably made of layers of laminated cardboard.

Figure 9:
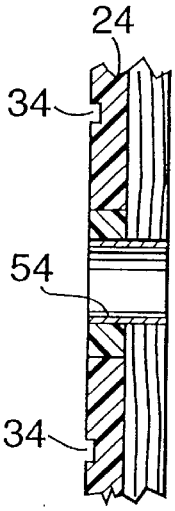
FIG. 9 is a cross-sectional view through part of the flange showing the metal bushing.

Referring to the embodiment shown in FIG. 9, in accordance with an embodiment of the invention, central channel 52 is reinforced by a metal bushing 54.

Figure 10:
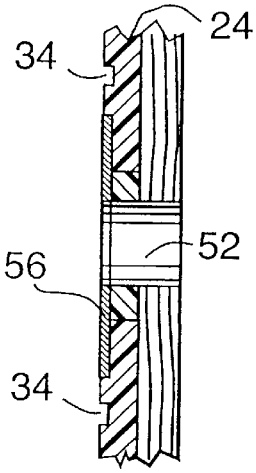
FIG. 10 is a cross-sectional view through part of the flange showing the reinforcing plate.
Figure 12:
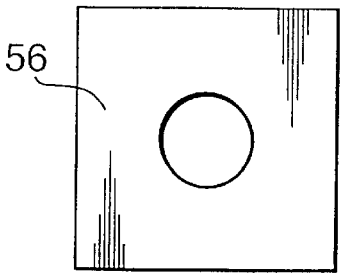
FIG. 12 is a top view of the reinforcing plate of FIG. 10.

Referring to the embodiment shown in FIG. 10, in accordance with a further embodiment of the invention, central channel 52 is reinforced by a reinforcing plate 56. Reinforcing plate 56 is shown separate from flanges 22, 24 in FIG. 12.

Preferably, drum 26 and flanges 22, 24 are selected to be of dimensions to satisfy the requirements of the North American Electrical Manufacturers' Association (NEMA) for the diameter and length of the particular cable wound around drum 26. NEMA publishes the standards for electrical supply manufacturing.

Figure 13:
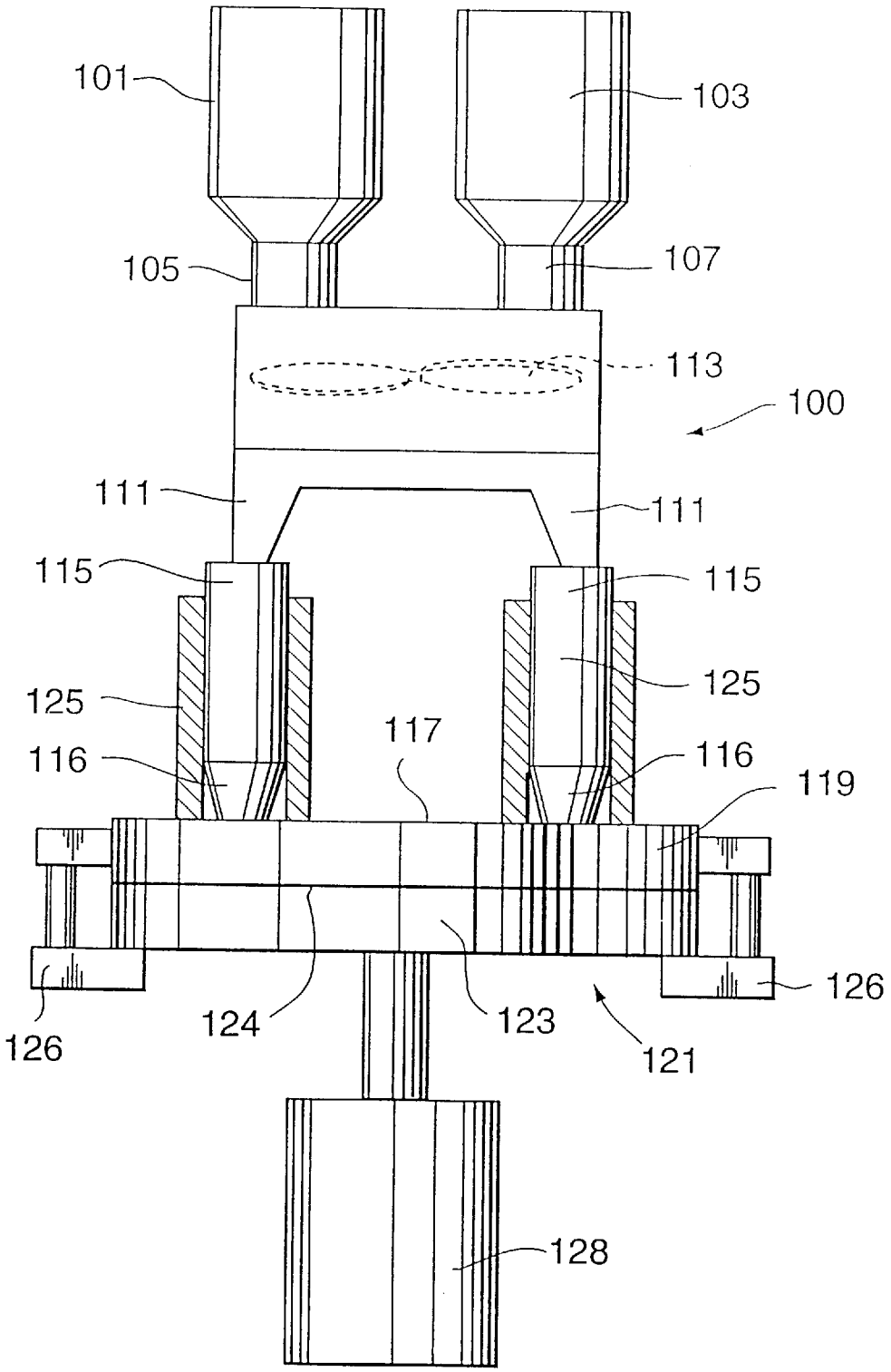
FIG. 13 is a schematic elevation view of an apparatus suitable for manufacturing a cable reel in accordance with the principles of the present invention.

To manufacture the flanges 22, 24, and sometimes the drum 26, in accordance with the present invention, rubber and plastics are granulated and then mixed using an apparatus such as that schematically illustrated in FIG. 13 and designated generally as 100. Preferably, the rubber input to apparatus 100 includes used vehicular tires or other waste material, which is granulated to a "crumb" size, preferably in the order of about one quarter inch in maximum dimension. Typically, the rubber would be granulated by a rubber granulator 101 and then supplied via a rubber output conduit 105 to a mixing chamber 109 provided with a mixing impeller 113 or other suitable mixing device. The impeller 113 may also act in an auger-like manner to drive the mix material downwardly.

Plastics materials, preferably recycled polyethylene plastics materials, are granulated to a particle size of approximately the size of the granulated rubber materials by a plastics granulator 103. The output granulated plastics material is then supplied via a plastics output conduit 107 to the mixing chamber 109.

The output granular flow via the output conduits 105, 107, is regulated so that the rubber-plastics material ratio within the mixing chamber 109 is in accord with design values determined empirically, and which will vary depending on the dimensions of the cable reel and also depending on the physical characteristics of the particular waste plastics and rubber material used.

There may be added to mixing chamber 109, ultraviolet stabilizing materials such as carbon, suitably in a ratio of not more than about 3% of the total volume of the material in the mixing chamber 109.

Other materials can, if desired, be provided in the mixture by way of filler or to improve the bonding capabilities between the elastomeric particles and the plastics continuum in which they are embedded in the final molded article.

The material in the mixing chamber 109 is gravity fed via exit conduits 111 to an array of injection cylinders 115 spaced about the upper surface 117 of the upper half 119 of a mold 121 whose interior cavity is shaped and dimensioned to form a molded element from the material injected into the mold 121. As illustrated, the mold 121 is configured to mold reel flanges. Only two such cylinders 115 are illustrated in the schematic view of FIG. 13; four or more such cylinders 115 could be provided, the objective being to fill the interior of mold 121 completely with mixed granulated material. The mold 121 also comprises a lower mold half-section 123, the two halves 119, 123 being separable from one another along a line of separation 124. Spaced at suitable intervals around the periphery of the mold 121 are a series of toggle clamps 126 which can be released following the molding operation to permit the two halves 120, 122 to be separated along the line of separation 124 thereby to permit the molded cable reel or similar article, within the mold 121 to be extricated. The opening and closing of the mold 121 is affected by a suitable hydraulic cylinder/piston arrangement generally indicated as 128.

Although various means of heating the material to be molded to the desired molding temperature may be devised, it is convenient to provide an induction heater 125 as a collar around the lower neck portion of each injection cylinder 115. Each heater 125 applies sufficient heat (e.g., at a temperature of about 180°–275° F.) to the material in the associated injection cylinder 115 that the plastics portion of the material will be molten and will tend to carry with it the elastomeric particles (that do not melt) into the mold cavity of mold 121 to fill the cavity substantially completely without voids.

Alternatively, the heaters 125 could be replaced by infrared catalytic heaters fuelled by propane or natural gas. Such heaters are known per se, and are, for example, available under the trademark SURE SEAL from Sure Seal Protection System Ltd. of Edmonton, Alberta.

The material fed by mixing chamber 109 to injection cylinders 115 is metered at the output conduits 111 of the mixing chamber 109 so that the total amount of material in the injection cylinders 115 ready to be injected into the mold 121 is just sufficient to fill completely the mold cavity within the mold 121. Generally, one will allow for a slight surplus of material because the air volume of the material within the injection cylinders 115 cannot be precisely calculated.

The forward motion of a plunger (not shown) within the injection cylinders 115 operating at a suitable pressure, for example an applied pressure in the range of about 200–2000 psi, forces the metered amount of granular material within the injection cylinders 115 past the heaters 125, where the material is heated sufficiently to melt the plastics portion of the mixture and is then forced via injection cylinder output nozzles 116 into the mold cavity.

Because the molding pressure required to mold the cable reel or similar article tends to be high and because of the relatively large projected area of the cable reel flanges 22, 24, the requisite mold clamping force to keep the mold halves 119, 123 together during the molding operation tends consequently to be high. The mold 121 and associated toggle clamps 126 should be designed with this high clamping force requirement in mind.

Obviously, the shape and dimensions of the mold cavity 121 will be selected to meet the shape and dimensions of the eventual molded article. The manufacture of different sizes of molded article will be accommodated by substituting for the mold 121 similarly constructed molds having the requisite interior cavity dimensions.

The mold 121 is preferably provided with interior cooling water channels and connected via input and output ports (not shown) to a circulating water supply so that the mold temperature remains relatively cool, in accordance with conventional mold cooling practice. The molded article should cool to a temperature of about 50° to 75° C. before removal from the mold 121.

The rate of flow of coolant through the mold 121 should be regulated so that the mold 121 maintains a temperature within a preferred range. Too cold a mold tends to cause cracking of the molded article, while too hot a mold tends to cause distortion of the cable reel, particularly the flanges of the cable reel.

Ideally, a control system for the entire operation will be provided that includes appropriate temperature, pressure, volume and time-monitoring devices at various selected points of the apparatus 100. The provision of feed-back loops with suitable regulating devices, preferably operated in conjunction with suitable computer software, will facilitate the obtention of a satisfactory molded article for each injection cycle.

Cable reels and spools manufactured according to the above process and using the above-described apparatus, may vary in size from about a ½-inch drum diameter to about a 5-foot drum diameter, whilst the flanges can vary from about 3 inches in diameter to about 10 feet in diameter. The length of the drum between the flanges (the drum traverse available to the cable) can vary from about 1½ inches to about 5 feet.

Other variations consistent with the invention will readily occur to those skilled in the art.

We claim:

1. For use in the transportation and storage of cable of length, diameter and weight up to a predetermined reel capacity, a cable reel comprising:

(a) a generally cylindrical cable-receiving drum, said drum selected to be of a material and of dimensions to resist bending of said drum under the load of the cable wound on said drum and to resist torsional stress due to cable loading and unloading stresses; and (b) a pair of opposed flanges fixed to the ends of said drum for retaining wound cable in place on said drum and for resisting the lateral load applied to the cable reel by the wound cable, said flanges being of a selected blended rubber-plastics composition and of dimensions selected to resist bending due to the lateral load of the cable wound on said drum and to the stress applied to said flanges by said drum bearing the cable.

2. A cable reel as defined in claim 1, wherein said rubber is used vehicular tire rubber.

3. A cable reel as defined in claim 2, wherein said flanges are substantially identical.

4. A cable reel as defined in claim 3, wherein said plastic comprises high-density polyethylene.

5. A cable reel as defined in claim 4, wherein said drum comprises a plurality of transversely extending staves, each of said plurality of staves having one end constrained to one of said flanges and the other end constrained to the other of said flanges.

6. A cable reel as defined in claim 5, wherein said plurality of staves are detachable from said flanges.

7. A cable reel as defined in claim 6, wherein each of said flanges is provided with a groove, and each of said plurality of staves has one end retained in one of said flanges by projecting into an associated one of said grooves, and the other end retained in the other of said flanges by projecting into the other of said grooves.

8. A cable reel as defined in claim 7, wherein the thickness of each of said staves is selected to match the width of each said grooves within a tolerance permitting each end of each of said staves to fit into said grooves.

9. A cable reel as defined in claim 8, additionally comprising a plurality of bolts, each of said plurality of bolts extending transversely from one of said flanges to the other of said flanges and attaching to said flanges to hold the assembly of flanges and staves together.

10. A cable reel as defined in claim 9, wherein each of said plurality of bolts are detachable from said flanges.

11. A cable reel as defined in claim 10, wherein said plurality of bolts are positioned within the cylindrical space enclosed by said plurality of staves.

12. A cable reel as defined in claim 11, wherein said plurality of staves are made of wood.

13. A cable reel as defined in claim 11 wherein said plurality of staves are made from a rubber blended with a plastic material.

14. A cable reel as defined in claim 13 wherein said plastic material comprises high-density polyethylene.

15. A cable reel as defined in claim 4 wherein (a) said drum comprises a cylinder made from a rubber blended with a plastic material; and (b) each of said flanges comprise a generally circular groove having a groove width selected to match the thickness of said drum so that each of the two opposed ends of said drum is retained by a unique one of said two flanges by extending into an associated one of said generally circular grooves.

16. A cable reel as defined in claim 15 wherein said plastic material comprises high-density polyethylene.

17. A cable reel as defined in claim 15, additionally comprising a plurality of bolts, each of said plurality of bolts extending transversely from one of said flanges to the other of said flanges and attaching to said flanges to hold the assembly of said flanges and said drum together.

18. A cable reel as defined in claim 17 wherein said cylinder comprises a plurality of curved portions.

19. A cable reel as defined in claim 4 wherein each of said two flanges has a central channel for receiving an arbor positioned within the cylindrical space enclosed by said cylinder.

20. A cable reel as defined in claim 19 wherein each of said central channels is reinforced by a metal bushing.

21. A cable reel as defined in claim 19 wherein each of said central channels is reinforced by a metal plate.

22. A cable reel as defined in claim 4 wherein said drum and said flanges are selected to be of dimensions to satisfy the NEMA requirements for the diameter and the length of the cable.

23. A cable reel as defined in claim 4 wherein said drum is made of cardboard.

24. A cable reel as defined in claim 23 wherein said drum is made of a plurality of layers of laminated cardboard.

25. A cable reel as defined in claim 4 wherein said drum is made of metal.

26. A cable reel assembly comprising:

(a) a plurality of drum components for assembling into a generally cylindrical cable-receiving drum; and, (b) a pair of opposed flanges attachable to the ends of said drum for retaining wound cable in place on said drum, said flanges being formed of a rubber-plastics composition.

27. A cable reel assembly as defined in claim 26, wherein said rubber is used vehicular tire rubber.

28. A cable reel assembly as defined in claim 27, wherein said flanges are substantially identical.

29. A cable reel assembly as defined in claim 28, wherein said plastic comprises high-density polyethylene.

30. A cable reel assembly as defined in claim 29 further comprising a plurality of transversely extending staves for assembly into said drum, each of said plurality of staves having one end for constraining to one of said flanges and the other end for constraining to the other of said flanges.

31. A cable reel assembly as defined in claim 30, wherein, after assembly, said plurality of staves are detachable from said flanges.

32. A cable reel assembly as defined in claim 31, wherein each of said flanges is provided with a groove, one end of each of said plurality of staves being retainable in one of said flanges by projecting into an associated one of said grooves, and the other end being retainable in the other of said flanges by projecting into the other of said grooves.

33. A cable reel assembly as defined in claim 32, wherein the thickness of each of said staves is selected to match the width of each said grooves within a tolerance permitting each end of each of said staves to fit into said grooves.

34. A cable reel assembly as defined in claim 32, additionally comprising a plurality of bolts for (a) extending transversely from one of said flanges to the other, and (b) attaching to said flanges to retain the assembly of flanges and staves together.

35. A cable reel assembly as defined in claim 34, wherein, after assembly, each of said plurality of bolts is detachable from said flanges.

36. A cable reel assembly as defined in claim 35, wherein, when assembled, said plurality of bolts are positioned within the cylindrical space enclosed by said plurality of staves.

37. A cable reel assembly as defined in claim 36, wherein said plurality of staves are made of wood.

38. A cable reel assembly as defined in claim 37 wherein said plurality of staves are made from a rubber blended with a plastic material.

39. A cable reel assembly as defined in claim 38 wherein said plastic material comprises high-density polyethylene.

40. A cable reel assembly as defined in claim 29 wherein (a) said drum comprises a cylinder made from a rubber blended with a plastic material; and (b) each of said flanges comprise a generally circular groove having a width selected to match the thickness of said drum within a tolerance permitting each of the two opposed ends of said drum to be attached to a unique one of said two flanges by extending into an associated one of said generally circular grooves.

41. A cable reel assembly as defined in claim 40 wherein said plastic material comprises high-density polyethylene.

42. A cable reel assembly as defined in claim 40, additionally comprising a plurality of bolts for extending transversely from one of said flanges to the other of said flanges and attaching to said flanges to hold the assembly of said flanges and said drum together.

43. A cable reel assembly as defined in claim 42 wherein said cylinder comprises a plurality of curved portions for assembling to form said cylinder.

44. A cable reel assembly as defined in claim 29 wherein each of said two flanges has a central channel for receiving an arbor positioned within the cylindrical space enclosed by said cylinder.

45. A cable reel assembly as defined in claim 44 wherein each of said central channels is reinforced by a metal bushing.

46. A cable reel assembly as defined in claim 44 wherein each of said central channels is reinforced by a metal plate.

47. A cable reel assembly as defined in claim 29 wherein said drum and said flanges are selected to be of dimensions to satisfy the NEMA requirements for the diameter and the length of the cable.

48. A cable reel assembly as defined in claim 29 wherein said drum is made of cardboard.

49. A cable reel assembly as defined in claim 48 wherein said drum is made of a plurality of layers of laminated cardboard.

50. A cable reel assembly as defined in claim 29 wherein said drum is made of metal.

* * * * *